US005242367A

United States Patent [19]

Marmin

[11] Patent Number: 5,242,367

[45] Date of Patent: Sep. 7, 1993

[54] APPARATUS FOR CUTTING AND FOLDING A WEB OF MATERIAL

[75] Inventor: Jean-Claude Marmin, Estrees, France

[73] Assignee: Heidelberger Druckmaschinen AG, Heidelberg, Fed. Rep. of Germany

[21] Appl. No.: 932,174

[22] Filed: Aug. 19, 1992

[30] Foreign Application Priority Data

Aug. 19, 1991 [FR] France ..... 91 10411

[51] Int. Cl.[5] ..... B65H 45/16

[52] U.S. Cl. ..... 493/359; 493/429; 493/424

[58] Field of Search ..... 493/359, 424, 425, 426, 493/427, 428, 429, 430, 431, 432, 433

[56] References Cited

U.S. PATENT DOCUMENTS

| | | | |
|---|---|---|---|
| 3,460,823 | 8/1969 | Neal | 493/431 |
| 4,176,833 | 12/1979 | Heimlicher | 493/426 |
| 5,057,064 | 10/1991 | Michalik | 493/424 |

*Primary Examiner*—Bruce M. Kisliuk
*Assistant Examiner*—Jack Lavinder
*Attorney, Agent, or Firm*—Kenyon & Kenyon

[57] ABSTRACT

The present invention relates to a folder for a rotary offset printing press comprising a transfer cylinder, a first-fold cylinder and a second fold cylinder. Each of the cylinders is constructed of two imbricated independent parts, and inner part and an outer part, moveable relative to one another and equipped with a respective driving gear. The drive gears of the respective cylinders are coupled to one another two-by-two so that coincidence between the cylinders is preserved. The drive gears of the transfer cylinder are connected to one another by a first pair of coupling gears coaxial relative to one another and interconnected by a first disengageable coupling and the drive gears of the first-fold cylinder being connected to one another by a second pair of coupling gears coaxial relative to one another and interconnected by a second disengageable coupling. An adjustment device for varying the angular displacement between the pairs of elements of the respective cylinders when the first and second disengageable couplings are in a disengaged position so as to convert the folder from a configuration that forms second parallel folds to one that forms delta folds.

15 Claims, 10 Drawing Sheets

PRIOR ART

PRIOR ART

APPARATUS FOR CUTTING AND FOLDING A WEB OF MATERIAL

FIELD OF THE INVENTION

The present invention relates generally to an apparatus for cutting and folding a web of material, and more particularly to a folder in a rotary offset printing press.

BACKGROUND OF THE INVENTION

Known folders in rotary offset printing presses convert a continuous web of printed paper into a series of books or pamphlets folded according to various types of folds. These machines usually make two folds: the first fold is a cylinder fold or tabloid fold, and the second fold may be either a parallel fold or delta fold. The second fold is typically made so that point holes formed on the web appear on the inside of the final product. The web is generally already folded in half before entering the folder by a device called a former. The former continuously folds the web in the longitudinal direction so that a fold parallel to the edges of the web width is created.

Because of various customer demands, it is necessary that folders be able to make both second parallel folds and delta folds. Therefore, such folders must be able to assume two different configurations which are necessary for making both types of folds.

These folders are comprised of a cutting cylinder, a transfer cylinder, a first-fold cylinder, and a second-fold cylinder. The cutting cylinder has a cutting blade which engages with a cutting counterpart on the transfer cylinder for cutting the web into signatures. The transfer cylinder is equipped with pairs of spur bars and engaging blades which cooperate with first-fold jaws on the first-fold cylinder for forming a first fold in the signature. The first-fold cylinder is equipped with pairs of first-fold jaws and second fold jaws which cooperate with pairs of grippers and engaging blades disposed on the second-fold cylinder for forming a second fold in the signature.

The spacing between each of the respective pairs of elements of the respective cylinders determines the type of fold that is created. Therefore, in order to change the type of fold made, the spacing between the respective elements must be altered. This change can translate into angular displacements of between 10° and 20° to convert the folder from a configuration which forms second parallel folds to one that forms delta folds.

These angular displacements are far greater than the angular displacement that these cylinders are generally capable of when each of the cylinders is produced in two imbricated independent parts movable relative to one another and equipped with respective driving gears. In fact, such a form of construction is often employed to make it possible to adjust the lap length by introducing a slight angular offset (typically only a few degrees) between the respective driving gears, these gears moreover being coupled to one another two-by-two in order to preserve coincidence between the elements which must cooperate with one another during the passage of the paper web between two adjacent cylinders. To adjust the lap length, a single double-helical pinion is used which is driven by each respective pair of gears of the relevant cylinder during the normal operation of the folder. One portion of this pinion meshes with one of the gears, and the other portion meshes with the other gear. The operator effects a slight axial translational movement of this double.helical pinion, the axis of which remains parallel to that of the relevant Cylinder, thereby making it possible to obtain a slight angular displacement in the desired direction between the associated pair of gears. However, such a relative angular adjustment can only be used for displacements of a few degrees.

Therefore, this technique for adjusting the lap length is virtually impractical for the purpose of obtaining angular displacements of the magnitude of 10 to 20°. To obtain angular displacements of 10 to 20°, a translational movement of a length ten to twenty times greater than that which the double.helical pinion is capable, may be necessary. Although that solution is theoretically possible, it is typically not used in practice, because the lateral bulk of the folder is considerably increased.

This explains why, in conventional folders, the removal of the various groups of elements on the relevant cylinders is carried out manually. In fact, an operator usually has to remove all the first-fold engaging blades from the transfer cylinder in order to readjust them in relation to the spur bars, all the second-fold jaws of the first-fold cylinder in order to readjust them in relation to the first-fold jaws, and all the second fold engaging blades of the second-fold cylinder in order to readjust them in relation to the grippers. These operations are complicated, involve the use of various tools and cause a rather lengthy operational shutdown of the press.

Various other solutions have also been proposed for modifying the configuration of a universal folder for the purpose of obtaining either a second parallel fold or a delta fold., For example, some use one or more specialized cylinders for the delta fold and other specialized cylinders for the second parallel fold. Although this may avoid the individual operations of removing and refitting the elements of these cylinders, it nevertheless still involves shutting down the machine and manually substituting the specialized Cylinders. This solution is incomplete, since operator intervention is still necessary, a relative long shut down is still required, and specialized cylinders are required.

Another proposed solution involves rotating the various parts of the cylinders by means of complex drives, e.g., "harmonic drives". However, this solution is costly and complex.

Therefore, all of these solutions are either difficult to put into practice, requiring manual intervention inside the machine, or are costly and complex.

OBJECTS AND SUMMARY OF THE INVENTION

An object of the present invention is to provide a universal folder, the structure of which can easily be modified to change folding formats, that is automatic, requires minimal machine down time, and that is simple and cost effective.

Another object of the present invention is to provide a folder, having a structure which makes it possible to easily vary to a large extent the position in which the various folds are formed.

A further object of the present invention is to maintain all the gears constituting the cinematic chain of the folder in intimate contact and to prevent the takeup of the gear backlash during the acceleration or deceleration of the printing press.

The present invention provides an apparatus for cutting and folding a web of material, comprising: a transfer cylinder having at least one spur bar and at least one associated engaging blade disposed thereon; a first-fold cylinder adjacent to the transfer cylinder having at least one first-fold jaw and at least one associated second fold jaw disposed thereon; and a second-fold cylinder adjacent to the first-fold cylinder having at least one gripper and at least one associated engaging blade disposed thereon, the transfer, first-fold and second-fold cylinders each being defined by two imbricated independent parts, an inner part and an outer part, moveable relative to one another, each independent part having an associated drive gear, the drive gears of the respective cylinders being coupled to one another two-by-two so that coincidence between the cylinders is preserved, the drive gears of the transfer cylinder being connected to one another by a first pair of coupling gears coaxial relative to one another and interconnected by a first disengageable coupling for disengaging the first pair of coupling gears when changing the apparatus from one folding mode to another so that the inner and outer parts of the transfer cylinder can rotate relative to one another, and the drive gears of the first-fold cylinder being connected to one another by a second pair of coupling gears coaxial relative to one another and interconnected by a second disengageable coupling for disengaging the second pair of coupling gears when changing the apparatus from one folding mode to another so that the inner and outer parts of the transfer cylinder can rotate relative to one another.

The present invention further provides an adjustment means, connected to the drive gear of the inner part of the transfer cylinder and to the drive gear of the outer part of the second-fold cylinder, for varying the angular displacement between the pairs of elements of the respective cylinders when the first and second disengageable couplings are in a disengaged position so as to convert the apparatus from one folding mode to another.

Other characteristics and advantages of the present invention will become apparent from the following description and accompanying drawings.

DETAILED DESCRIPTION

Figure 1A:
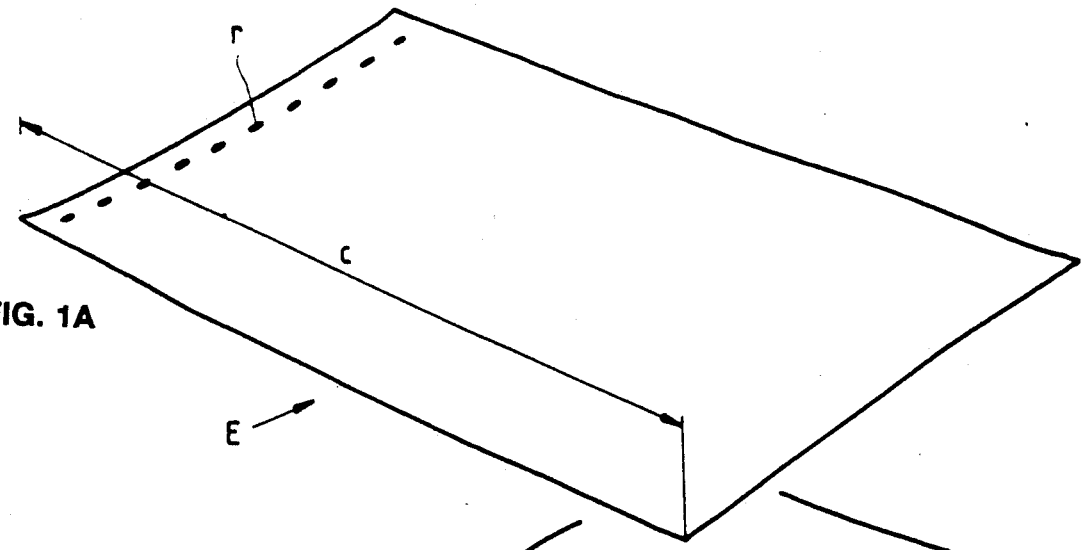
FIGS. 1*a–c* are a diagrammatic view illustrating the steps in forming a first cylinder fold and a second parallel fold on a copy (Prior Art)
Figure 1B:
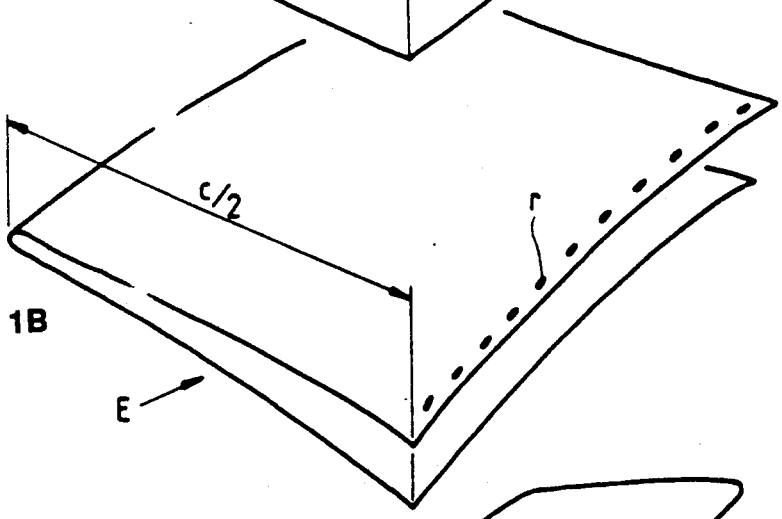
Figure 1C:
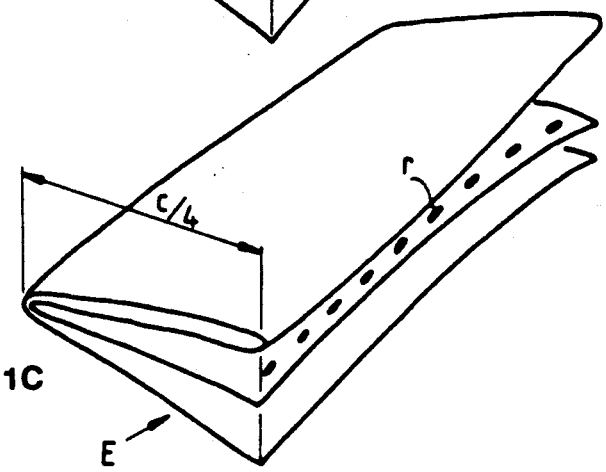
FIG. 1C PRIOR ART
Figures 2A, 2B, 2C:
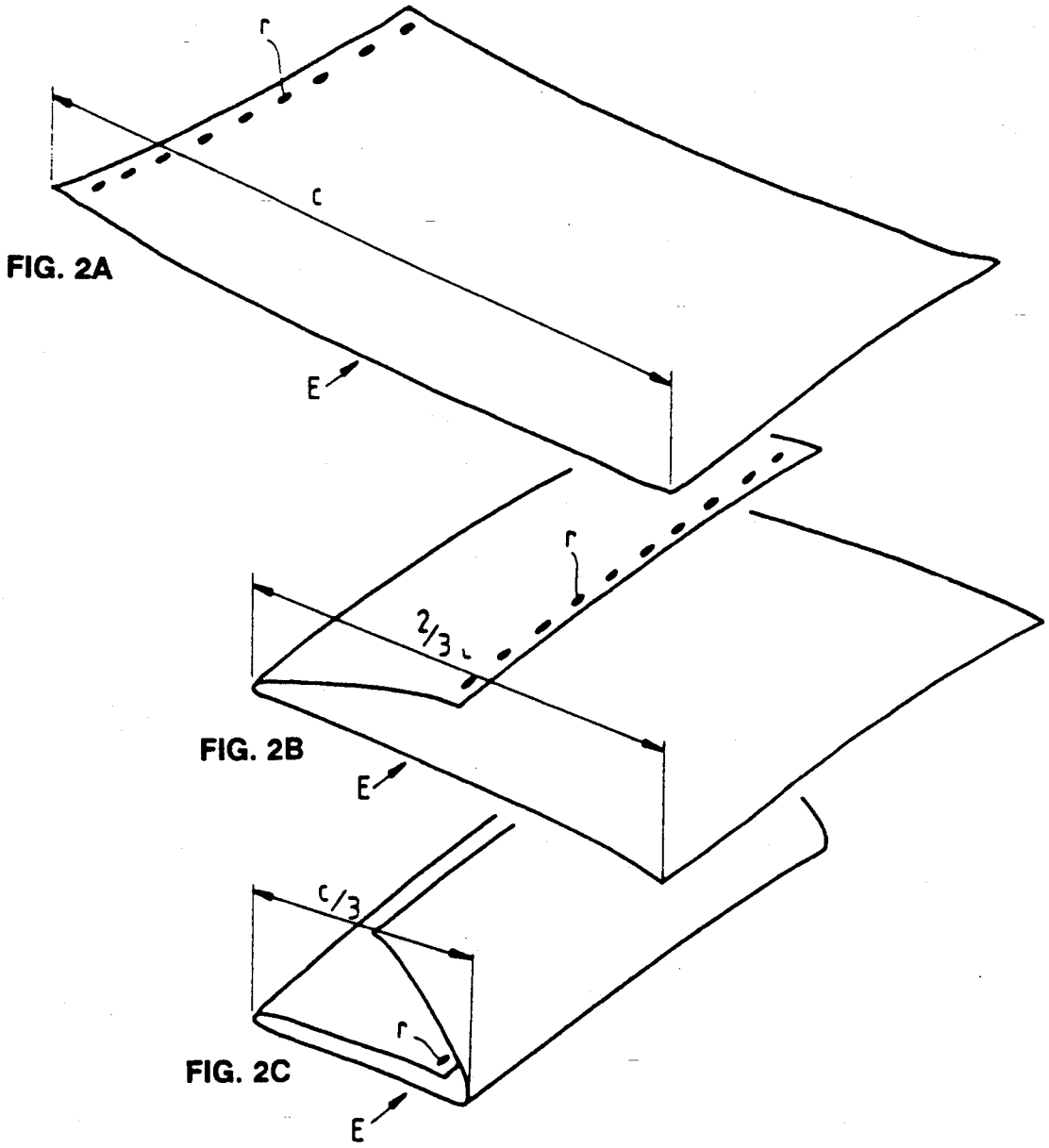
FIG. 2C PRIOR ART
FIGS. 2*a–c* are a diagrammatic view illustrating the steps in forming a delta fold on a copy (Prior Art)

FIGS. 1 and 2 illustrate the successive steps in the formation of a parallel fold and a delta fold, respectively. In FIG. 1 a printed copy receives a first cylinder fold and a second parallel fold. At A) is shown a copy E, such as is obtained after the cutting of the web as it passes between a cutting cylinder and a transfer cylinder of the folder, the copy having a cutting length c. The copy E has marks r, represented by dots, which correspond to the holes created by spurs on the transfer cylinder which secure the copy to the surface of the transfer cylinder. The copy E can be either a single web or a double web already folded by a former, in which case one of the longitudinal edges corresponds to the fold made by the former. At B), the copy E has undergone a folding in the middle of its length to c/2 by passing between the transfer cylinder and a first-fold cylinder of the folder. At C), the copy E has once again undergone a mid-length folding, thus reducing its length to c/4, by passing between the first-fold cylinder and a second-fold cylinder of the folder. This second fold is called the "second parallel fold". The folds are made so that the holes r end up on the inside of the finished product.

Similarly, FIG. 2 illustrates the formation of a delta fold from a copy E, as described in connection with FIG. 1, and having a cutting length c, after a passage of the web between the cutting cylinder and the transfer cylinder, as illustrated at A). At B), the copy E has undergone a folding similar to the first fold described in connection with FIG. 1, but this first fold is made over the first third of the length of the copy to c/3, after passage between the transfer cylinder and the first-fold cylinder. The length of the copy is then 2c/3. In order to carry out this folding, it is necessary to modify the configuration of the transfer cylinder in relation to that used for the first folding carried out according to FIG. 1. The configuration of the first-fold cylinder likewise has to be adapted accordingly, as will be described below. At C), the copy has undergone a second folding, again to c/3, but this time with respect to the other part of the cut web: this results in a second fold, called a delta fold, and the copy has a length of c/3. Since this delta fold is obtained by the passage of the cut web between the first-fold cylinder and the second-fold cylinder of the folder, it will therefore be appreciated that the configuration of these cylinders also has to be modified in relation to that for making a second parallel fold corresponding to FIG. 1.

Figure 3:
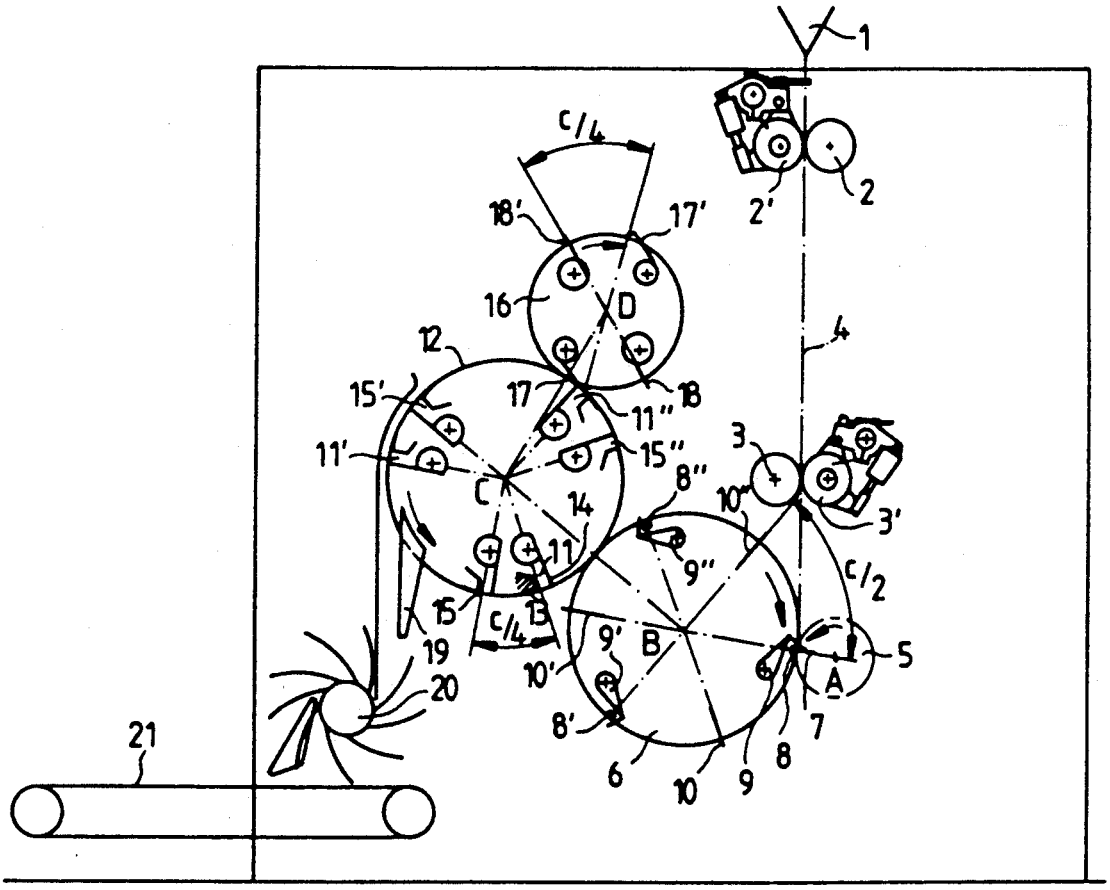
FIG. 3 is a view of a known folder configuration which forms a second parallel fold (Prior Art)

A conventional folder is illustrated in FIG. 3. This folder comprises a triangle 1, which forms a longitudinal fold in the continuously travelling web of material 4. Such a former is well known to those skilled in the art and is not part of the present invention. The web 4 is fed into the folder by two pairs of draw rollers 2, 2' and 3, 3' having elastomeric surfaces pressed against one another.

The web 4 first passes between a cutting cylinder 5 and a transfer cylinder 6. A cutting blade 7 disposed along one of the generatrices of the cutting cylinder 5 cooperates with rubber blade counterparts 8, 8' and 8', disposed on the periphery of the transfer cylinder 6. Preferably, the circumference of the cutting cylinder 5 is equal to the length c of the copy, so that exactly one copy is cut per rotation of the cutting cylinder.

The circumference of the transfer cylinder 6 is preferably equal to two or three times the length c of the copy (three times in FIG. 3). The transfer cylinder 6 has spur bars 9, 9' and 9', defined by a plurality of small needles projecting through the cylinder which penetrate into the paper web immediately before the web is cut by the cutting blade/cutting counterpart pair. Thus, the paper web 4, passing between the cutting cylinder 5 and the transfer cylinder 6, is cut by the cutting blade 7 which penetrates into the associated cutting counterpart 8, 8' or 8'', thereby producing separate copies retained on the transfer cylinder 6 by the associated spurs 9, 9' and 9''.

The transfer cylinder 6 also has engaging blades 10, 10' and 10'' disposed on its periphery at a location corresponding to half the length of each of the copies, i.e., c/2, for introducing the copies into associated jaws 11, 11' and 11'' disposed on a first-fold cylinder 12. The transfer cylinder 6 is thus equipped with pairs of spur bars and engaging blades, each pair of elements taking the place of the preceding one for every rotation of 120°. The spacing between the space bars and the engaging blades of the transfer cylinder 6 is equal to a length of c/2, which corresponds to an angular displacement of 60°.

The web 4 next passes between the transfer cylinder 6 and a first-fold cylinder 12 which is defined by first-fold jaws 11, 11' and 11'' intended for cooperating with the engaging blades 10, 10' and 10'' on the transfer cylinder 6, and second-fold jaws 15, 15' and 15'' intended for cooperating with engaging blades 18 and 18' provided on a second-fold cylinder 16. In the embodiment illustrated in FIG. 3, the first fold jaws 11, 11' and 11'', are each defined by a stationary part 13 which is integral with the first-fold cylinder 12 and against which a blade 14 (know as a "tucking blade") oscillates. The structure of the second-fold jaws 15, 15' and 15'' is preferably identical to that of the first-fold jaws 11, 11', and 11''. The first-fold cylinder 12 is therefore equipped with pairs of first-fold jaws and of second-fold jaws. The spacing between the first-fold jaws and the second-fold jaws, is equal to a length of c/4, which corresponds to an angular displacement of 30°.

The second fold cylinder 16 adjacent to, and parallel to, the first-fold cylinder 12 cooperates with the first-fold cylinder and comprises grippers 17 and 17' which cooperate with the first-fold jaws 11, 11', and 11'' of the first-fold cylinder 12. When a first fold jaw passes through the centerline between the first-fold cylinder 12 and the second-fold cylinder 16, this jaw opens, simultaneously the corresponding gripper of the second-fold cylinder 16 closes and grasps the copy already folded once. To form the second fold, the second fold cylinder 16 likewise includes engaging blades 18 and 18' which cooperate with the second-fold jaws of the first-fold cylinder 12 when these two elements pass through the centerline of the cylinders, while the associated gripper, by opening, releases the first fold of the copy. The spacing between the grippers and the engaging blades on the second fold cylinder is equal to a length of c/4, which corresponds to an angular displacement of 45°.

Thus, the cutting cylinder 5/transfer cylinder 6 pair cut the copies and wind them around the transfer cylinder 6, where they are retained at their heads by the spurs 9, 9' and 9''. The transfer cylinder 6/first-fold cylinder 12 pair subsequently form the first fold of the copy and retain this folded copy in the first fold jaws 11, 11' and 11'' of the first-fold cylinder. The process of forming the second fold then takes place as follows: The head of the copy (first fold) is held at the start of the cycle in the associated first-fold jaw of the first-fold cylinder 12, and the relevant gripper of the second-fold cylinder 16 grasps it as it passes through the centerline. Rotation subsequently continues, and the associated engaging blade of the second-fold cylinder 16 then engages the copy into a second fold jaw of the first-fold cylinder 12, this jaw closing during the passage of these two elements through the centerline, while the gripper, by opening, releases the first fold of the copy. At the end of the cycle, there is a copy which has received two folds parallel to one another and perpendicular to the direction of travel of the paper web and which is clamped by means of its second fold in the associated second-fold jaw of the first-fold cylinder 12.

A set of strippers 19 protruding into grooves formed in the first-fold cylinder 12 extract the copies and direct them into a slowly rotating star wheel or fan 20 which deposits them onto a conveyor belt 21 so that the copies overlap one another.

Therefore, when a second parallel fold is to be made, the folder is arranged such that the pairs of elements of the transfer cylinder, of the first-fold cylinder and of the second-fold cylinder have a spacing equal to c/2, c/4 and c/4, respectively, which corresponds to angular displacements of 60°, 30° and 45°.

Figure 4:
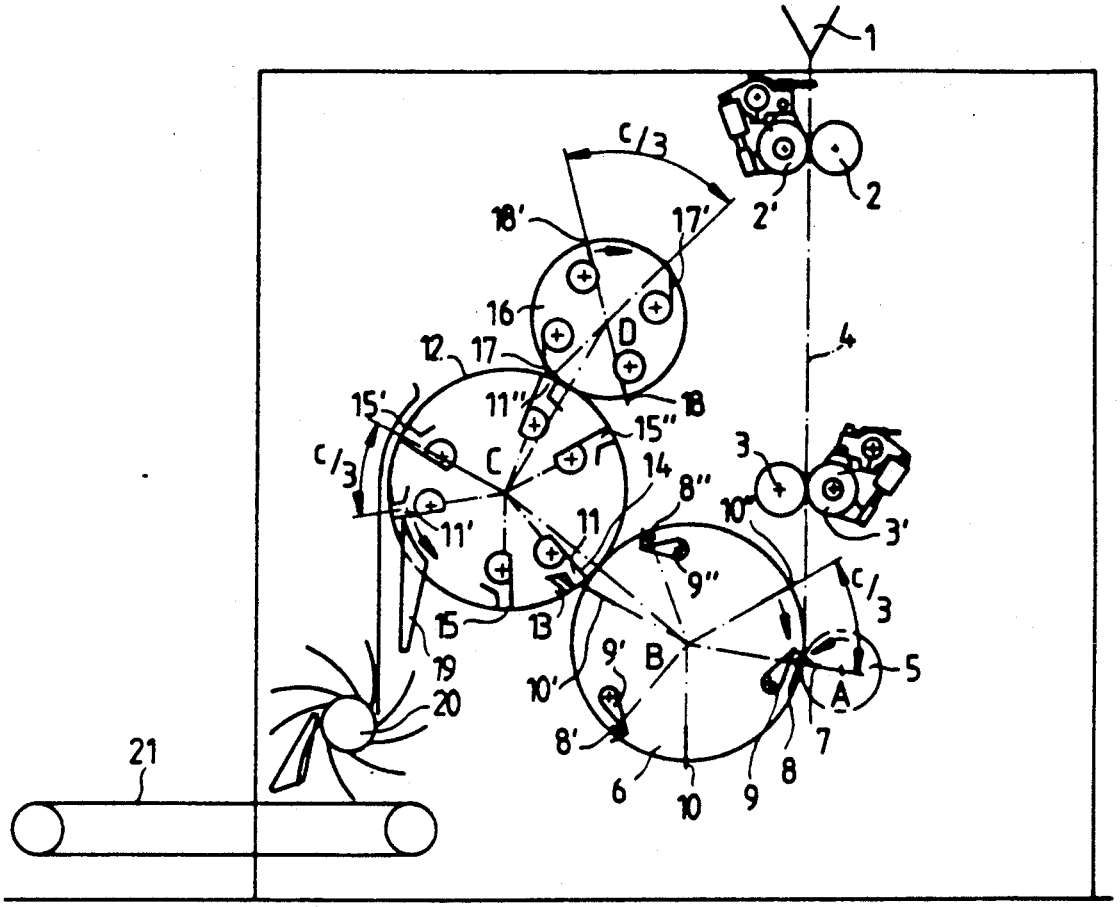
FIG. 4 is a view of a known folder configuration which forms a delta fold (Prior Art)

If a delta fold is desired, then it is necessary to modify the configuration of the folder. This entails changing the angular displacements between the pairs of elements of the transfer, first-fold and second-fold cylinders. FIG. 4 illustrates a configuration of the folder for forming delta folds. The spacings between the pairs of elements of the transfer cylinder 6, of the first-fold cylinder 12, and of the second-fold cylinder 16 become c/3, c/3 and c/3, respectively, which correspond to angular displacements of 40°, 40° and 60°.

In order to change from one configuration of the folder to another, changes in angular displacements between the respective pairs of elements of each of the cylinders are significant. With respect to the transfer cylinder 6, the spacing between each spur bar and each corresponding engaging blade must change from c/2 to c/3, which corresponds to an angular change from 60° to 40°, a difference of 20°. With respect to the first-fold cylinder 12, the spacing between each first-fold jaw and each corresponding second-fold jaw must change from c/4 to c/3, which corresponds to an angular change from 30° to 40°, a difference of 10°. Finally, with respect to the second-fold cylinder 16, the spacing between each gripper and each corresponding engaging blade must change from c/4 to c/3, which corresponds to an angular change from 45° to 60°, a difference of 15°.

Figure 5:
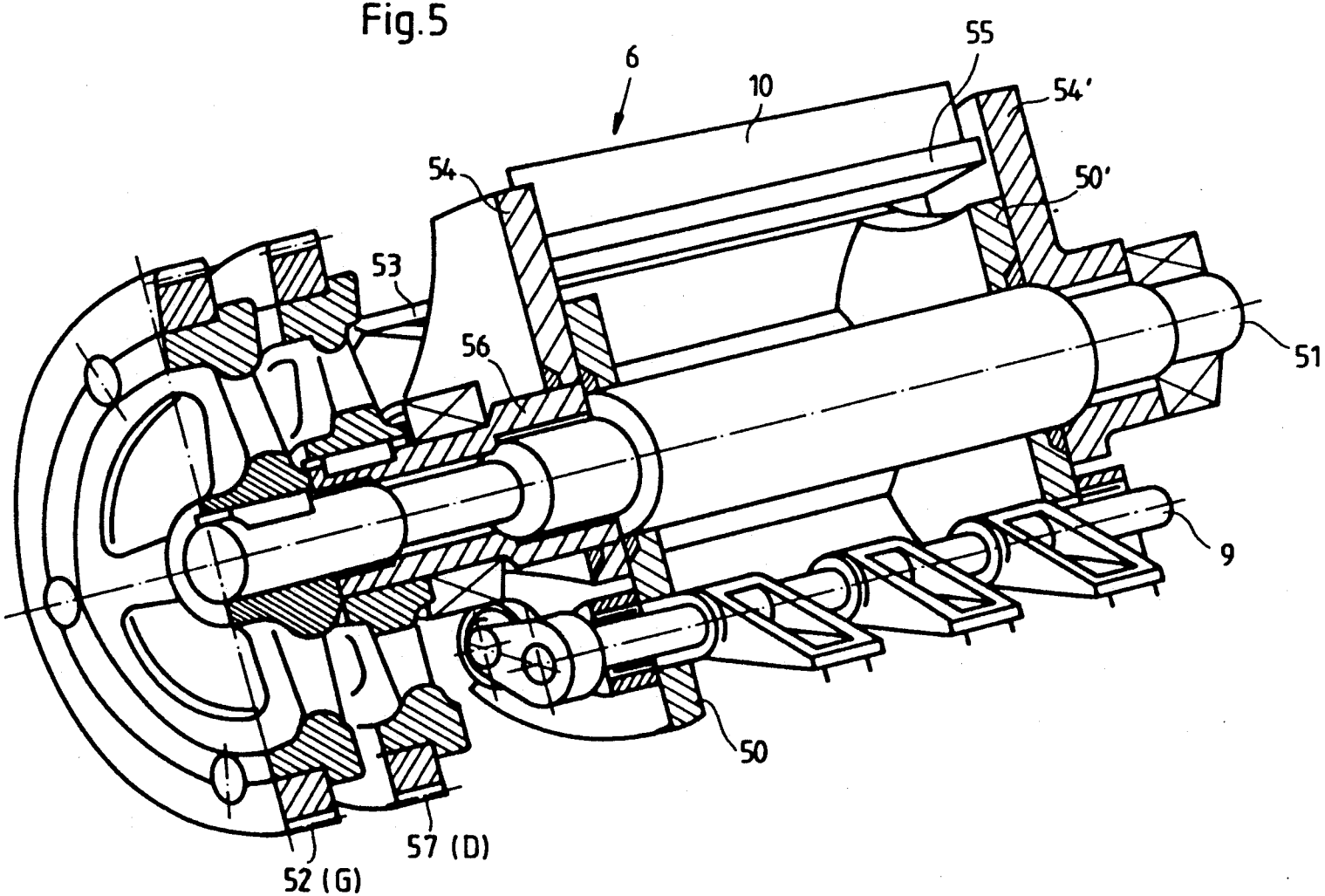
Fig.5 PRIOR ART
FIG. 5 is a perspective view of an axial section of a transfer cylinder (Prior Art)

FIG. 5 illustrates the structure of the transfer cylinder 6. This figure shows only one spur bar 9 and one engaging blade 10. To allow the relative displacement of the elements of the same type (spur bars or engaging blades) three by three, the transfer cylinder is formed into two imbricated independent parts, an inner part and an outer part, movable relative to one another and equipped with respective driving gears, according to the technique already adopted in known folders for obtaining an adjustment of the "lap length". This structure makes it possible to obtain a displacement of the three engaging blades 10, 10' and 10'' relative to the three spur bars 9, 9' and 9''.

The inner part is defined 50 and 50' welded to a shaft 51. The flanges 50 and 50' are connected to one another by three longitudinal plates (of which only one designated by 53 is illustrated) welded at 120°, in order to form part of the periphery of the transfer cylinder. The spur bars 9 are pivoted on the flanges 50 and 50'.

The outer part is defined by two flanges 54 and 54' mounted rotatably on the shaft 51. The flanges 54 and 54' are connected to one another by three longitudinal plates, of which only one designated by 55 is illustrated. The engaging blades 10 are mounted on these longitudinal plates. The flange 54 is extended externally and axially by a tubular extension 56, itself mounted rotatably on the shaft 51. A gear 52 is keyed onto one end of the shaft 51 and a gear 57 is keyed onto the tubular extension 56. The gear 52 directly drives the inner part carrying the spurs, while the gear 57 directly drives the outer part carrying the engaging blades. The driving gears 52 and 57 are preferably of the helical type, one having a left-handed helix and the other a right-handed helix, for reasons which will be explained below.

The first-fold cylinder 12 is constructed in the same way as the transfer cylinder 6 illustrated in FIG. 5, with the first-fold jaws 11, 11' and 11'' being disposed on the inner part and the second-fold jaws 15, 15' and 15'' being disposed on the outer part.

The second fold cylinder 16 is also constructed in a similar manner with the grippers 17 and 17' being disposed on the inner part and the engaging blades 18 and 18' being disposed on the outer part. However, since the second-fold cylinder 16 has a symmetry of the order of two rather than of the order three, only two sets of longitudinal plates are needed to connect the respective flanges of the inner parts and outer parts.

Therefore, FIG. 5 which illustrates the particular structure of the transfer cylinder 6, also serves for describing the structure of the first-fold cylinder 12 and the second-fold cylinder 16. The respective driving gears, which can be seen in FIG. 7, are gears 65 and 66 for the first-fold cylinder 12 and gears 74 and 75 for the second-fold cylinder 16.

The structure of the means for modifying the configuration of the folder for the purpose of obtaining either a second parallel fold or a delta fold, which constitutes part of the present invention, will now be described in detail with reference to FIGS. 6 to 10.

Figure 6:
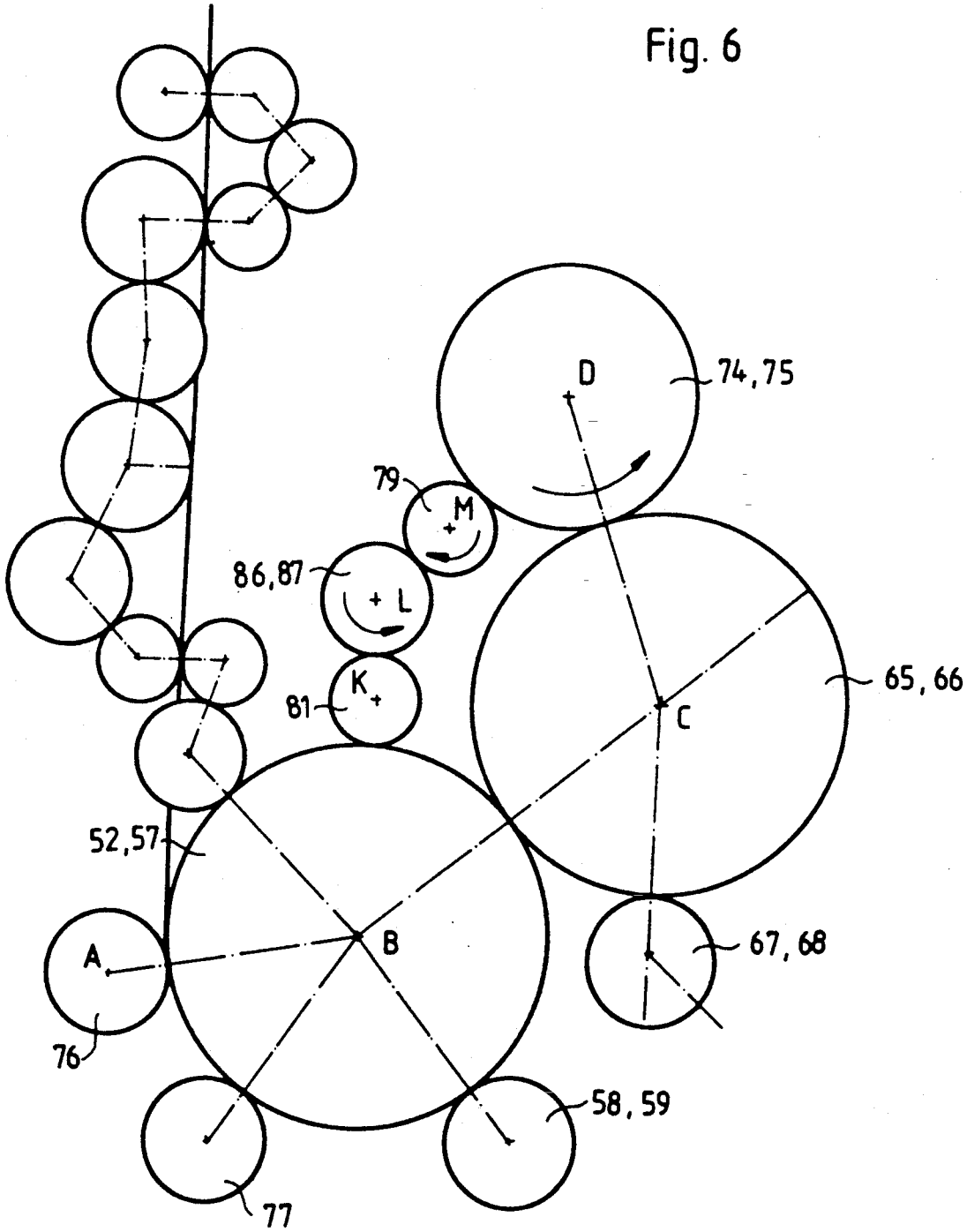
FIG. 6 is a diagrammatic view illustrating, in elevation, gears of a folder according to the present invention.
Figure 7:
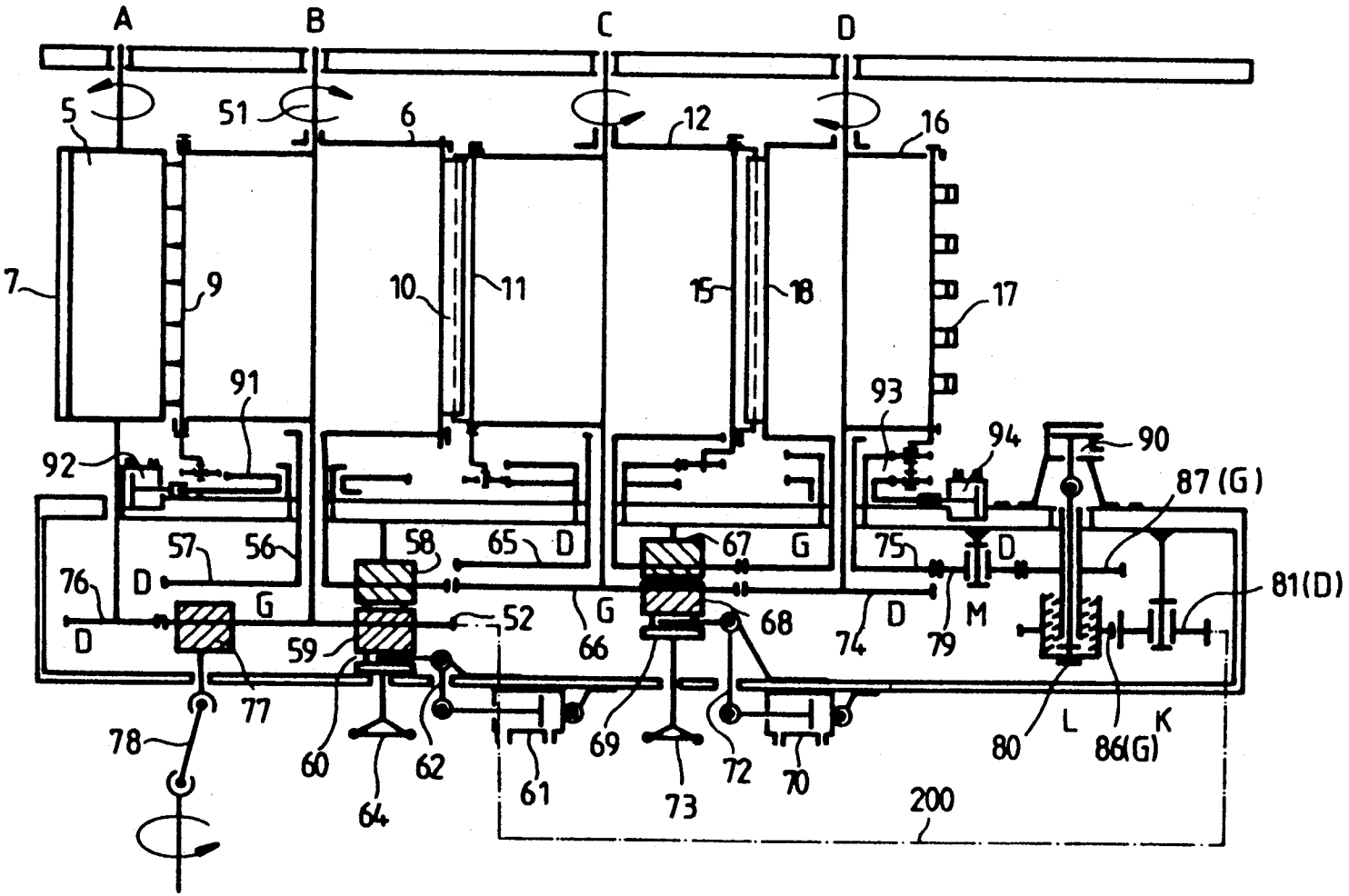
FIG. 7 is a schematic view of the folder according to the present invention.

FIG. 7, which is a planar view of a known folder incorporating the present invention and of which the line in FIG. 6 corresponds to the sequence A, B, C, D, M, L, R, illustrates, in section, the various cylinders of the folder, their shafts, connecting gears and the cams controlling the shafts. There can thus be seen the cutting cylinder 5 with its cutting blade 7, the transfer cylinder 6, the inner part of which carries the spur bars 9, 9' and 9'' and the outer part of which carries the engaging blades 10, 10' and 10'', the first-fold cylinder 12, the inner part of which carries the first-fold jaws 11, 11' and 11'' and the outer part of which carries the second fold jaws 15, 15' and 15'' and the second-fold Cylinder 16, the inner part of which carries the grippers 17 and 17' and the outer part of which carries the engaging blades 18 and 18'.

FIG. 7 also shows an assembly of the various gears associated with each cylinder, these gears having, as appropriate, a left-handed helix (designated by the letter G) or a right-handed helix (designated by the letter D). There can thus be seen the gear 76 keyed on the shaft of the cutting cylinder 5, the coaxial gears 52 and 57 associated with the two parts of the transfer cylinder 6, the coaxial gears 66 and 65 associated with the two parts of the transfer cylinder 12, and finally the gears 74 and 75 associated with the two parts of the second-fold cylinder 16.

The present invention provides that, the driving gears 52, 57 of the two independent parts of the transfer cylinder 6 and the driving gears 66, 65 of the two independent parts of the first-fold cylinder 12 are connected to one another by respective pairs of gears 59, and 68, 67 coaxial relative to one another and interconnected by disengageable couplings.

During normal operation, the corresponding couplings are in the engaged position and the respective pairs of gears 59, 58 and 68, 67 form an assembly integral in terms of rotation. In this case, the folder is driven by a pinion 77 which in turn is driven by a Cardan transmission 78 connected to an electric motor which drives the printing press. The pinion 77 meshes with the gear 52 connected to the inner part of the transfer cylinder 6. The gear 52 drives both the gear 76, which in turn drives the cutting cylinder 5, and the pair of gears 59, 58, which in turn drive the gear 57 of the transfer cylinder 6, thus ensuring the drive of the transfer cylinder. The gear 57 then drives the gear 66, which in turn drives the engaged pair of gears 68, 67, which in turn drive the gear 65, thus ensuring the drive of the first-fold cylinder 12. The gears 66 and 65 mesh with the gears 74 and 75, respectively, and thus ensure the drive of the second fold cylinder 16.

By disengaging the coupling of the gears of each respective pair 59, 58 and 68, 67, it is possible to temporarily disconnect the coupling connections between the pairs of gears 52, 57 or 66, 65 of the transfer cylinder 6 or of the first-fold cylinder 12, respectively, thus allowing a perfect angular adjustment of the pairs of relevant elements of each of the three relevant cylinders for the purpose of modifying the configuration of the folder to obtain either a second parallel fold or a delta fold. The disengagement is preferably accomplished by associated actuation means. There are, of course, a plurality of means which can be used for disengaging the coupling between each respective pair of gears 59, 58 and 68, 67. Such a disengageable coupling could be provided by, for example, an associated indexed magnetic denture clutch.

FIG. 7 shows a disengageable coupling provided by a claw 60 for the pair of gears 59, 58 and a claw 69 for the pair of gears 68, 67, each claw having two fixed positions limited by two abutments and corresponding to one or the other of the configurations of the folder for the purpose of obtaining either a second parallel fold or a delta fold. Thus, each respective pair of gears 59, 58 and 68, 67 constitutes an actual fold-adjusting device. The claws 60 and 69 can be controlled manually by an operating wheel or by a pneumatic or hydraulic air cylinder or by an electromagnet or by any other control means. FIG. 7 shows means of control by a double-acting air cylinder 61 and an associated linkage 62 for the claw 60 and a double-acting jack 70 and an associated linkage 72 for the claw 69.

Figures 8, 8A, 8B:
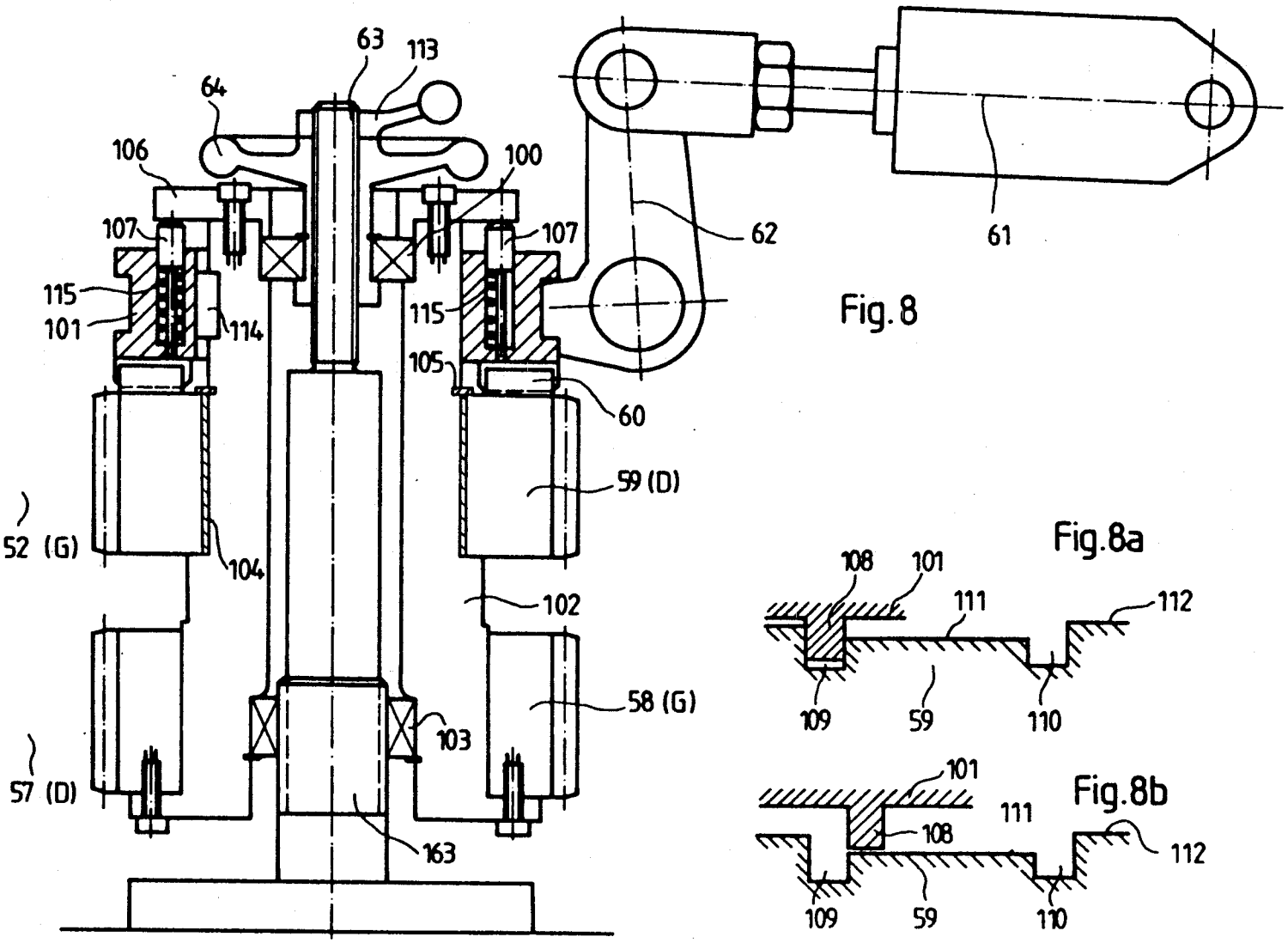
FIG. 8 is a partial view illustrating a particular embodiment of a disengageable coupling of the folder according to the present invention.
FIGS. 8*a* and 8*b* are two laid-out sectional views illustrating a claw of the disengageable coupling in FIG. 8 in he engaged position (8*a*) for one of the two configurations of the folder and in the disengaged intermediate position (8*b*) during a change of the configuration.

The structure of these disengageable couplings can be more clearly understood by reference to FIG. 8 which illustrates the means associated with the pair of gears 59, 58 associated with the transfer cylinder 6. Identical means are used for the other pair of gears 68, 67 associated with the first-fold cylinder 12.

FIG. 8 shows an associated shaft 163 which is fastened to the frame of the folder and on which a sleeve 102 is rotatably mounted by a roller bearing 103. The gear 58 is securely mounted on the sleeve 102. In contrast, the gear 59 is rotatably mounted on the sleeve 102 with a bronze ring 104 and a stop ring 105, respectively, ensuring the rotation and translational immobilization of the gear on the sleeve.

A collar 101, keyed freely on the sleeve 102 by mean of an associated key 114, constitutes the movable element of the Claw 60. The collar 101 comprises a plurality of plunger pistons 107 subjected to the action of associated springs 115, the free end of the pistons bearing against a washer 106 fastened to the upper part of the sleeve 102. The collar 101 can thus occupy two axial positions, a low position corresponding to an engaged position of the claw 60, and a high position in abutment against the bearing washer 106 corresponding to a disengaged position of the claw. The air cylinder 61 and the associated linkage lever 62 cooperate to displace the collar 101 between these two axial positions.

FIG. 8*a* is a laid-out view of the interlocked position illustrated in FIG. 8 which shows a finger 108 projecting below the collar 101 which can penetrate either into a notch 109 or into a notch 110 of the gear 59. Each notch corresponds to the relative angular positions between the collar 101 and the gear 59, and hence between the gears 58 and 59. Each notch also corresponds to the respective configurations of the folder for the purpose of obtaining either a second parallel fold or a delta fold.

When the air cylinder 61 is actuated to disengage the coupling obtained by the claw 60, the collar 101 is in abutment against the associated washer 106 and the finger 108 is released from the notch 109, so that the finger can pass over an intermediate surface 111 between the notches 109 and 110, while at the same time remaining below the peripheral surface 112 of the gear 59, as illustrated in FIG. 8*b*. Thus, the finger 108 of the collar 101 has an angular displacement limited by its two end abutment positions in line with the two notches 109 and 110. The passage from one notch to the other when the claw 60 is disengaged is obtained by associated adjustment means which will be described later.

FIG. 8 further shows a device for additional adjustment corresponding to a fine adjustment of the "lap length" of the copy. The shaft 163 terminates at threaded end 63, onto which is screwed an adjusting wheel 64, the axial position of which is ensured by a locking counternut 113. An angular-contact ballbearing 100 defined by an outer ring and inner ring is provided between the wheel 64 and the sleeve 102, the outer ring of the bearing is clamped between the washer 106 and the sleeve 102, and the inner ring is integral with the wheel 64.

By releasing the counternut 113, it becomes possible to rotate the wheel 64 in one direction or the other which axially displaces the sleeve 102, and therefore the gears 58 and 59 connected to it. Since the gears 58 and 59 are helical in opposite directions (gear 58 is a left-handed helix and gear 59 is a right-handed helix), this axial movement of the sleeve 102 in relation to the shaft 163 gives rise to a relative rotational movement between the gearwheels 52 and 57 and consequently a relative movement between the engaging blades and the spur bars of the transfer cylinder 6. The rotation of the wheel 64 can be carried out either by hand or by means of an associated motor allowing remote adjustment.

A device with the same structure and the same mode of operation as the one which has just been described with respect to the transfer cylinder 6 with reference to FIG. 8, is used for adjusting the projecting lap of the second fold in the region of the first-fold cylinder 12. FIG. 7 shows the wheel 73 which is similar to the wheel 64. By rotating the wheel 73, it is possible to displace the two helical gears 68, 67 axially and to execute a relative rotational movement between the gears 66 and 65, thus displacing the first-fold jaws relative to the second-fold jaws on the first-fold cylinder 12.

The overall translational movement of one or the other respective pair of gears 59,, 58 or 68, 67 executed for such an adjustment of the lap length results in angular displacements of only a few degrees, and hence can only be used to make fine adjustments.

The structure of the adjustment means, which makes it possible to vary the angular displacement between the pairs of elements of the transfer cylinder 6, the first-fold cylinder 12 and the second-fold cylinder 16, so as to convert the folder from a second fold mode to a delta fold mold, also constitutes part of the present invention and will now be described.

According to a preferred embodiment illustrated in FIG. 7, this adjustment means comprises a reversible screw/nut system 80, the screw of which carries one gear 87 and the nut of which carries another gear 86, and an associated air cylinder 90 making it possible to bring these two concentric gears 87, 86 towards or away from one another, in order to generate a torque between them in one direction or the other according to the desired configuration. The gear 86 is connected to the gear 52 which is connected to the inner part of the transfer cylinder 6, whereas the gear 87 is connected to the gear 75 which is connected to the outer part of the second-fold cylinder 16, in order to form a closed loop.

The reversible screw/nut system is connected to the gears 52 and 75 by means of intermediate gears 81 and 79 pivoted on the frame of the folder, as shown in FIG. 7. The gear 79 meshes with the gear 75 of the second-fold cylinder 16 and the gear 81 meshes with the gear 52 of the transfer cylinder 6, the latter meshing connection being represented diagrammatically in FIG. 7 by a dot-and-dash line 200. The exact structure of the reversible screw/nut system 80 is better illustrated in FIG. 9 which will now be described.

The reversible screw/nut system 80 is a torque-generating device for modifying the configuration of the folder for the purpose of obtaining the desired second fold, which comprises a hollow shaft 95 mounted rotatably on the frame of the folder by means of two bearings 82 and 83. The shaft 95, forming the screw of the reversible screw/nut system 80, carries over a particular length a high-pitch helical ramp 84, onto which is screwed a bronze nut 85 forming the nut of the reversible screw/nut system. The gear 87 is keyed to the shaft 95, whereas the gear 86, coaxial with the shaft, is integral with the nut 85. Screwing the nut 85 on the shaft 95 toward or away from the frame of the folder produces relative rotation of the gears 86 and 87, thereby making it possible to exert a torque in one direction or the other so as to rotate one part of the meshing loop in relation to the other part after the opening of the loop in the region of one or the other of the two claws.

Figure 9:
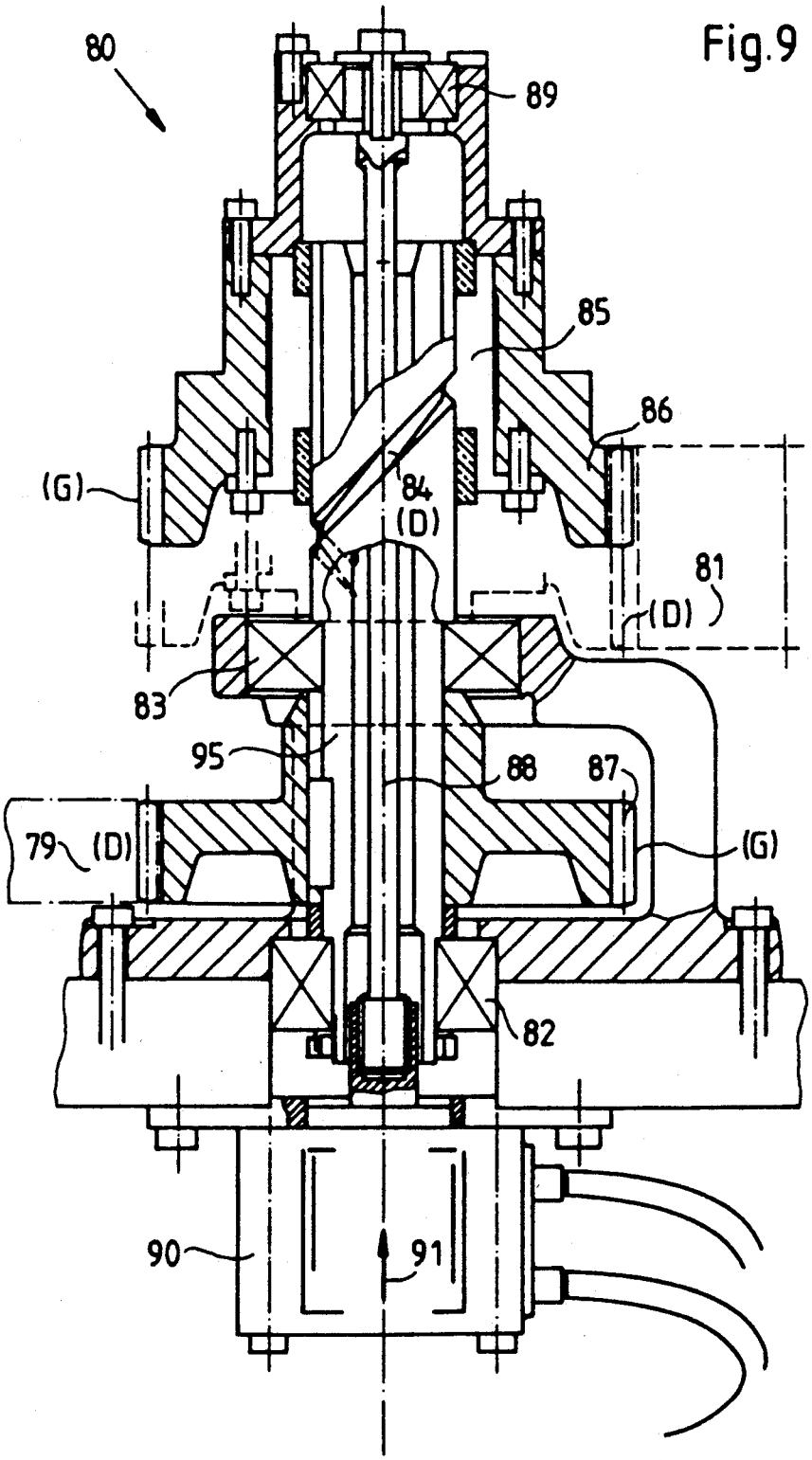
FIG. 9 is a sectional view of a particular embodiment of an adjustment means which varies the angular displacement between the pairs of elements of the relevant cylinders.

The nut 85 is screwed on the shaft 95. A central rod 88 passes concentrically inside the shaft 95, the rod having at one end a ballbearing 89 for connecting it to the nut 85 and gear 86 assembly, and at its other end a connection to the rod of an actuating air cylinder 90, the cylinder of which is connected to the frame of the folder, as shown in FIG. 9. When the air cylinder 90 exerts a push or pull on the rod 88, the rod forces the gear 86, via the bearing 89, to slide rotatably on the shaft 95. If the gear 86 has a left-handed helix and the helical ramp 84 is right-handed, as shown in FIG. 9, the rotational effects are added and the longitudinal sliding of the gear 86 corresponds to the exertion of a torque between the gears 86 and 87, the intensity and direction of this torque depends respectively on the force generated by the air cylinder 90 and on its direction of action, i.e., in the direction of the arrow 125 or in the opposite direction.

The torque generated at the meshings of the loop is added to the load moment of the folder when the air cylinder 90 pushes on the system in the direction of the arrow 125. This, therefore, makes it possible, by feeding the air cylinder 90 during the operation of the folder, to apply a force, the effect of which is to cancel any anti-backlash existing in the driving direction of the gear train. The shaft 95 of the reversible screw/nut system 80 can thus be subjected to a permanent tractive force, in order to perform an additional anti-backlash-compensating function during the continuous operation of the folder. This tractive force can be produced by means of the air cylinder 90 of the reversible screw/nut system 80, as just described, but can also be produced by another means, for example, a compression spring (not shown) bearing on the frame of the folder. In the latter case, the air cylinder 90 is only used for modification of the configuration of the folder for the purpose of obtaining either a second parallel fold or a delta fold.

In an alternative version of the reversible screw/nut system 80, it is possible to employ other adjustment means, for example, the driving means of the folder 77, 78, can be actuated in slow motion in one direction or another according to the desired configuration, the second-fold cylinder 16 in this case being immobilized by an associated brake (not shown) When the second fold cylinder 16 is immobilized and either the claw 60 or the claw 69 is in the disengaged position, the rotation of the folder in one direction or the other makes it possible to execute the desired relative rotational movements for the cylinder associated with the disengaged claw. However, this latter solution is less efficient than the preceding one because the advantage of the additional anti-backlash-compensating function during the continuous operation of the machine is lost.

Figure 10:
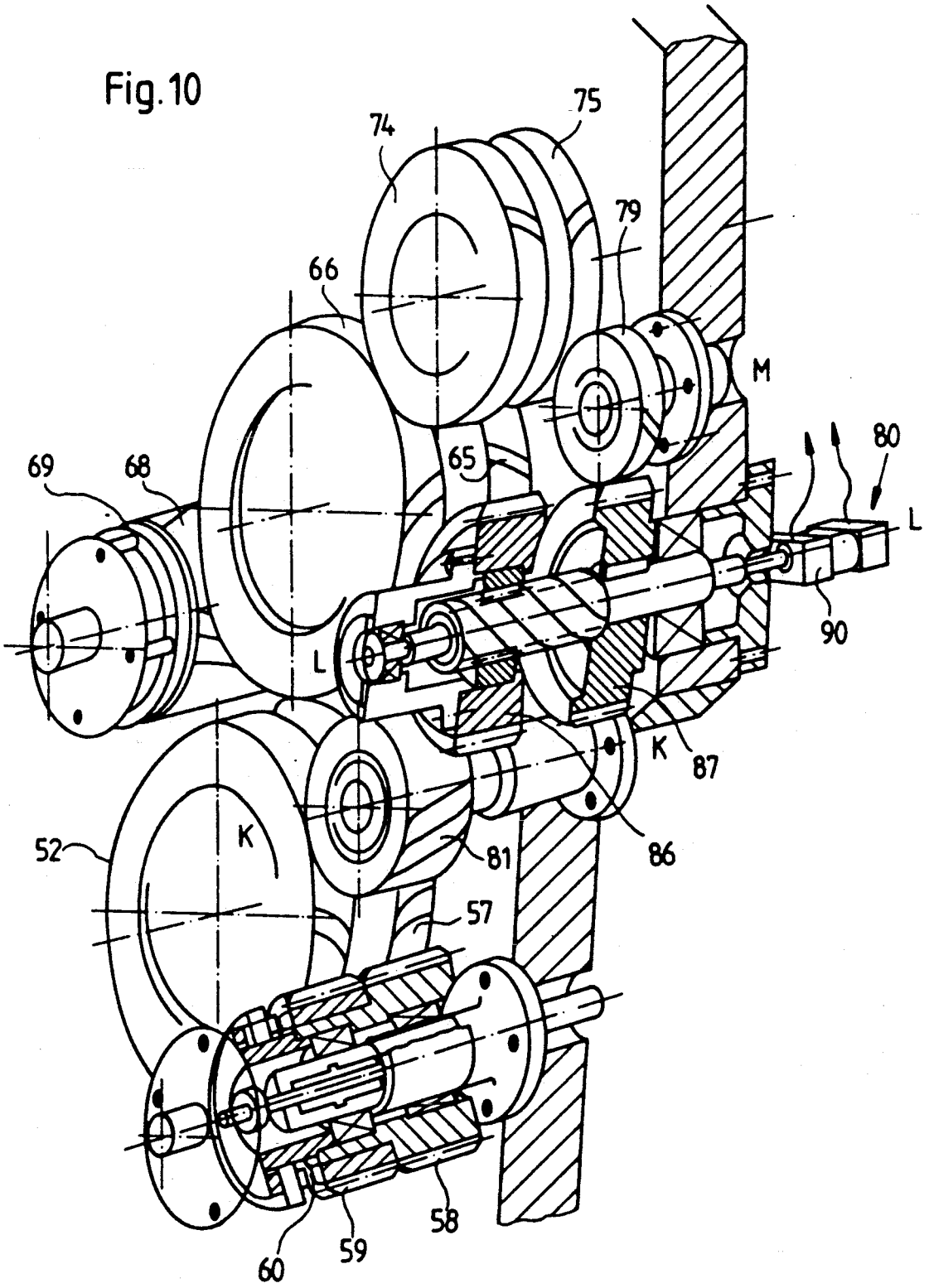
FIG. 10 is a partially cut away perspective view illustrating the closed loop of gears of the present invention according to the embodiment of FIG. 7.

The notion of a closed loop, affording the possibility of anti-backlash-compensation, will be clearly understood by reference to the diagrammatic representation of FIG. 6, which shows the various gears of a folder according to the present invention and a pinion chain serving for driving the draw rollers 2, 2' and 3, 3 of the folder, and to the partially cut away perspective representation of FIG. 10.

To change the configuration of the folder from a second parallel fold mode to a delta fold mode using the reversible screw/nut system 80 described above, the present invention operates as follows:

The air cylinder 90 of the screw/nut system 80 is bled to relax the bearing force of the claw 60 against the associated abutment (in its notch). The class 60 is then disengaged by actuation of the double-acting air cylinder 61. The air cylinder 90 of the screw/nut system 80 is then actuated in the direction opposite to the arrow 125. This causes the two parts of the transfer cylinder 6 to rotate in the appropriate direction and make it possible to bring each engaging blade towards each associated spur of the same pair of elements as a result of the rotation of the collar of the claw 60. The air cylinder 90 is then bled again without ay interfering torque to engage the claw 60 in its new notch. Engagement of the claw 60 is effectuated by means of the air cylinder 61. The claw 69 is then disengaged by the associated air cylinder 70. The air cylinder 90 of the screw/nut system 80 is then actuated in the direction of the arrow 125, thereby causing the rotation of the collar of the claw 69 into its new position and consequently a rotation of the two parts of the first-fold cylinder 12 in the appropriate direction. The air cylinder 90 is then bled again without any interfering torque to engage the claw 69. The engagement of claw 69 is effectuated by the associated air cylinder 70. The air cylinder 9 is finally bled in the direction of the arrow 125 to compensate for any backlash.

When these operations are concluded, the two parts of the second fold cylinder 16 are then automatically in the desired configuration as a result of the meshing of the associated gears 74 and 75 with the gears 66 and 65 of the first-fold cylinder 12.

The transfer cylinder 6, first-fold cylinder 12 and second-fold cylinder 16 are then in a configuration ready for forming a delta fold. However, this operation must be completed by a modification of the position of the cams acting on the spur bars of the transfer cylinder 6 and on the grippers of the second-fold cylinder 16. In fact, during the formation of the first fold, it is expedient to modify the release position of the spurs, this taking place as a result of the rotation of the associated cam 91 by means of a air cylinder 92, as illustrated in FIG. 7. Likewise, the release position of the grippers will be modified as a result of the displacement of part of a double cam 93 by means of an associated air cylinder 94 (in the latter instance, this is a double cam making it possible to have a fixed engagement, but a release of variable position, thus corresponding to a cam with a mask). The opening and closing movements of the various spurs, jaws and grippers are controlled, in fact, by cams integral with the frame and concentric with the relevant cylinder on which they act, these cams controlling rollers connected to the various shafts by means of levers in a manner entirely conventional for folders. Moreover, such an adjustment of release positions of the spur and grippers is well known to persons of ordinary skill in the art, so there is no need to describe them in greater detail.

To modify the configuration of the folder in order to change from a delta-fold mode to a second parallel-fold mode, all that is necessary is to execute the sequence of operations described above in reverse order.

Furthermore, all of the above operations can be performed automatically by means of an electro mechanical sequence or a microprocessor actuating solenoid valves and automatic control components.

The change of configuration of the folder carried out as described above, together with the mounting of a anti-backlash-compensating device, makes it possible to solve all the problems of synchronization which could be encountered if these operations were carried out manually. In fact, in view of the many backlashes between the various gears, the removal and refitting operations conducted manually on the known folders involved a risk of finding angular shifts in relation to the correct respective positions of the cooperating elements of the various cylinders, and this could cause damage to the engaging blades or the fold jaws. This disadvantage is now completely eliminated, since it is possible to obtain perfect synchronization, this being achieved without having to carry out additional adjusting or checking operations.

The present invention is not limited to the embodiments which have been described herein, but rather embraces any alternative embodiment which incorporates the essential characteristics set out above, or any equivalent thereof.

I claim:

1. An apparatus for cutting and folding a web of material, comprising:

a transfer cylinder having at least one spur bar and at least one associated engaging blade disposed thereon;

a first-fold cylinder adjacent to the transfer cylinder having at least one first-fold jaw and at least one associated second-fold jaw disposed thereon; and a second-fold cylinder adjacent to the first-fold cylinder having at least one gripper and at least one associated engaging blade disposed thereon, the transfer, first-fold and second-fold cylinders each being defined by two imbricated independent parts having an inner part and an outer part, moveable relative to one another, each independent part having an associated drive gear, the drive gears of the respective cylinders being coupled to one another two-by-two so that coincidence between the cylinders is preserved, the drive gears of the transfer cylinder being connected to one another by a first pair of coupling gears coaxial relative to one another and interconnected by a first disengageable coupling for disengaging the first pair of coupling gears when changing the apparatus from one folding mode to another so that the inner and outer parts of the transfer cylinder can rotate relative to one another, and the drive gears of the first-fold cylinder being connected to one another by a second pair of coupling gears coaxial relative to one another and interconnected by a second disengageable coupling for disengaging the second pair of coupling gears when changing the apparatus from one folding mode to another so that the inner and outer parts of the transfer cylinder can rotate relative to one another.

2. The apparatus according to claim 1, further comprising an adjustment means connected to the drive gear of the inner part of the transfer cylinder and to the drive gear of the outer part of the second-fold cylinder for varying the angular displacement between the pairs of elements of the respective cylinders when the first and second disengageable couplings are in the disengaged position so as to convert the apparatus from one folding mode to another.

3. The apparatus according to claim 2, wherein the coupling gears of the first and second pairs of coupling gears move translationally relative to one another along their respective axes of rotation over a short distance, so that the "lap length" of a corresponding fold can be varied by the adjustment means.

4. The apparatus according to claim 2, further comprising a means for moving the coupling gears of the first and second pairs of coupling gears translationally relative to one another along their respective axes of rotation.

5. The apparatus according to claim 2, wherein the adjustment means comprises a reversible screw nut system, the screw of which carries one gear and the nut of which carries another gear, both gears being concentric to one another, and an associated jack for bringing the two concentric gears towards or away from one another in order to generate a torque between them in one direction or another, one of the gears being connected to the drive gear connected to the inner part of the transfer cylinder, and the other being connected to the drive gear connected to the outer part of the second-fold cylinder, in order to form a closed loop.

6. The apparatus according to claim 5, wherein the adjustment means further comprises intermediate gears for connecting the concentric gears of the reversible screw/nut system to the gears of the respective cylinders.

7. The apparatus according to claim 5, wherein the jack associated with the reversible screw/nut system imparts a tractive force on the screw in order to perform an anti-backlash-compensating function during the continuous operation of the apparatus.

8. The apparatus according to claim 5, further comprising a compression spring bearing on a frame of the apparatus for imparting a tractive force on the screw in order to perform an anti-backlash-compensating function during the continuous operation of the apparatus.

9. The apparatus according to claim 2, wherein the adjustment means comprises driving means which drive the apparatus and which are actuated in slow motion in one direction or another according to the desired folding mode, the second-fold cylinder in this case being immobilized.

10. The apparatus according to claim 1, wherein the first and second disengageable couplings each comprise an associated claw having two fixed positions limited by abutments, each position corresponding to one or another folding mode.

11. The apparatus according to claim 10, wherein each claw is controlled by an associated pneumatic or hydraulic cylinder and an associated linkage.

12. The apparatus according to claim 10, wherein each claw is controlled manually by an associated operating wheel or automatically by an associated member, such as an electromagnet.

13. The apparatus according to claim 1, wherein the first and second disengageable couplings are gear indexed magnetic clutches.

14. The apparatus according to claim 1, wherein the drive gears mounted on the two independent parts of the transfer, first-fold and second-fold cylinders and their associated coupling gears are helical and for any two of these gears mounted on the same axle one gear is a left-handed helix and the other gear is a right-handed helix.

15. An apparatus for cutting and folding a web of material, comprising successively a cutting cylinder, a transfer cylinder equipped with pairs of spur bars and of engaging blades, a first-fold cylinder equipped with pairs of first-fold jaws and of second-fold jaws, and a second-fold cylinder equipped with pairs of grippers and of engaging blades, each of the abovementioned transfer, first-fold and second-fold cylinders comprising two imbricated independent parts moveable relative to one another and equipped with a respective driving gear, these driving gears being coupled to one another two-by-two in order to preserve coincidence between the elements which must cooperate with one another during the passage of the web between two adjacent cylinders, wherein the driving gears of the two independent parts of the transfer cylinder, on the one hand, and the driving gears of the two independent parts of the first-fold cylinder, on the other hand, are connected to one another by means of a respective pair of gears coaxial relative to one another and interconnected by means of a disengageable coupling, the disengagement of the coupling of the gears of each pair making it possible to vary the angular displacement between the pairs of elements of the relevant cylinder by associated actuation means, in order to modify the configuration of the machine for the purpose of obtaining either a second parallel fold or a delta fold.

* * * * *